United States Patent [19]

Marschke et al.

[11] Patent Number: 4,919,414

[45] Date of Patent: Apr. 24, 1990

[54] HANDLING, INCLUDING SQUARING, OF CONVEYED SHINGLED SHEETS

[75] Inventors: Carl R. Marschke; Richard H. Thomas; William D. Wendorf, all of Phillips, Wis.

[73] Assignee: Marquip, Inc., Pillips, Wis.

[21] Appl. No.: 251,121

[22] Filed: Sep. 29, 1988

[51] Int. Cl.[5] ..... B65H 29/22

[52] U.S. Cl. ..... 271/227; 271/176; 271/221; 271/240; 271/263; 271/273

[58] Field of Search ..... 271/227, 263, 238, 239, 271/240, 273, 274, 176, 221

[56] References Cited

U.S. PATENT DOCUMENTS

| | | | |
|---|---|---|---|
| 2,528,106 | 10/1950 | Albrecht | 271/240 |
| 2,893,731 | 7/1959 | Nordquist | 271/240 |
| 3,593,989 | 7/1971 | Crittenden | 271/238 |
| 3,974,953 | 8/1976 | Klose . | |
| 4,015,843 | 4/1977 | Tennant . | |
| 4,200,276 | 4/1980 | Marschke . | |
| 4,273,325 | 6/1981 | Rodewald . | |
| 4,598,901 | 7/1986 | Thomas . | |
| 4,776,578 | 10/1988 | Hirakawa | 271/227 X |

*Primary Examiner*—Richard A. Schacher

*Attorney, Agent, or Firm*—Andrus, Sceales, Starke & Sawall

[57] ABSTRACT

A shingle handling and squaring device (18) is disposed between a sheet shingler (5) and stacker (9) and mounted above a stack infeed conveyor (19). The device includes a pair of side carriages (23,24), each of which carries a pair of freely rotatable longitudinally in-line tamping rollers or wheels (29–32), the peripheries of which are adapted to engage an edge of the traveling sheet material (6). The wheels are mounted for rotation about generally vertical but slightly inclined axes (48) and have tapered peripheries (51) so that the wheels nevertheless present truly vertical faces to the sheet material. The wheels are counterbalanced (56). In addition, when the stacker infeed nip roll (17) is raised by the entry of shingled sheets, a device (57–60) is provided to release the nip roll from the sheets to prevent binding. While the nip roll is released, the side carriages are moved transversely inwardly toward the sheet edges in a unique manner such that even off-center sheets are automatically and properly engaged and squared by the tamping wheels before the stacker infeed nip roll is re-engaged with the sheets. Furthermore, an automatic jam detection and releasing arrangement (72,73,57) is associated with the upstream wheels (29,31) and which is responsive to excessive upward wheel lifting about a transverse axis (45).

11 Claims, 6 Drawing Sheets

18
19
17
4
4

FIG. 10
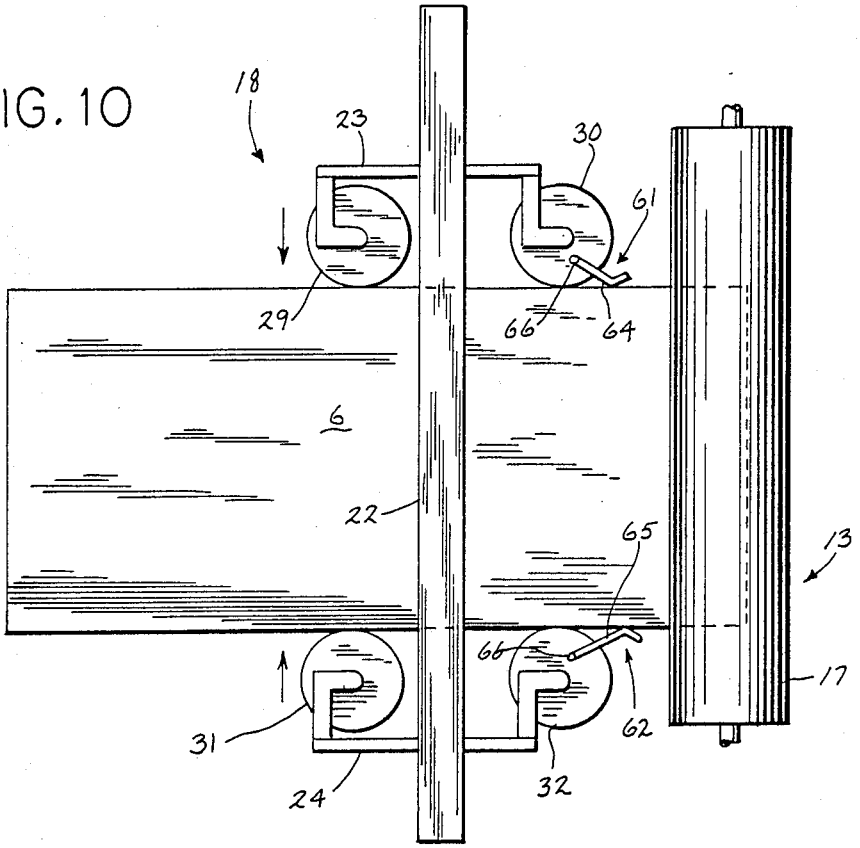
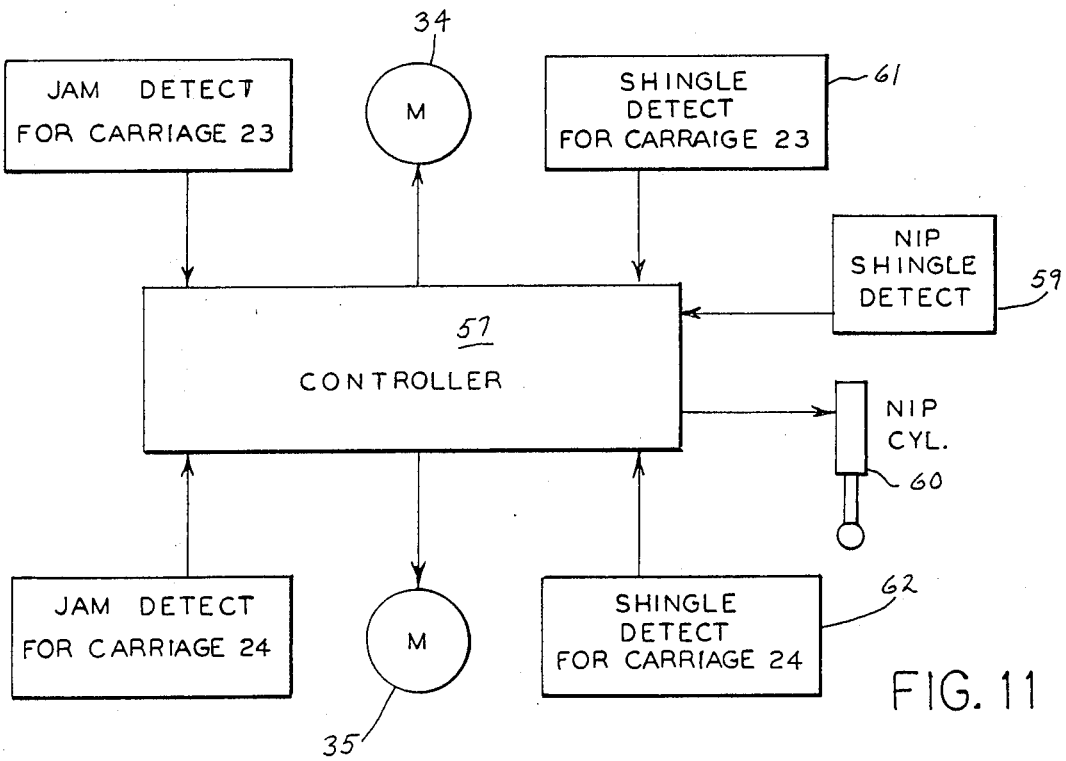
FIG. 11

HANDLING, INCLUDING SQUARING, OF CONVEYED SHINGLED SHEETS

BACKGROUND AND SUMMARY OF THE INVENTION

This invention relates to the handling, including squaring, of conveyed shingled sheets and is adapted to compliment concepts such as those disclosed in U.S. Pat. No. 4,200,276.

In that patent, a web of corrugated paperboard or the like is first cut into a plurality of individual sheets. The sheets are then conveyed to a shingler which forms them into overlapping arrangement. The shingles are then conveyed to a stacker for subsequent stacking and discharge. In the device of the patent, the sheets are conveyed at varying speeds through the use of an automatic control system.

A problem arises in the transportation of the shingled sheets between the shingler and stacker. After discharge from the shingler, the shingled sheets sometimes tend to twist or skew sideways on the supporting conveyor. If the shingled sheets enter the stacker in skewed condition, they do not feed straight in to the stacker throat, resulting in possible bending or other damage to the sheets.

Various solutions to the problem have been proposed and adapted in the past. Examples are illustrated in U.S. Pat. Nos. 4,273,325 and 4,598,901. It has also been proposed to convey sheet material along a conveyor and between side mounted belts or the like which may, in some instances, tend to keep the material longitudinally aligned.

It is an object of the present invention to provide for improved handling of conveyed sheet material, especially at high conveying speeds. It is a further object to provide for controlled and essentially automatic handling and squaring of sheets in an improved manner.

In accordance with various aspects of the invention, a shingle handling and squaring device is disposed between a sheet shingler and stacker and mounted above a stack infeed conveyor. The device includes side carriages, each of which carries a pair of freely rotatable longitudinally in-line tamping rollers or wheels, the peripheries of which are adapted to engage an edge of the traveling sheet material. The wheels are mounted for rotation about generally vertical but slightly inclined axes and have tapered peripheries so that the wheels nevertheless present truly vertical faces to the sheet material.

In addition, when the stacker infeed nip roll is raised by the entry of shingled sheets, a device is provided to release the nip roll from the sheets to prevent binding. While the nip roll is released, the side carriages are moved transversely inwardly toward the sheet edges in a unique manner such that even off-center sheets are automatically and properly engaged and squared by the tamping wheels before the stacker infeed nip roll is reengaged with the sheets.

Furthermore, an automatic jam detection and releasing arrangement is associated with the upstream wheels in the present embodiment, and which is responsive to excessive upward wheel lifting about a transverse axis.

BRIEF DESCRIPTION OF THE DRAWINGS

The accompanying drawings illustrate the best mode presently contemplated by the inventors for carrying out the invention.

In the drawings:

FIG. 10 is a showing similar to FIGS. 8 and 9 and illustrating the third or final squaring phase; and FIG. 11 is a diagram of the controls for the device.

DESCRIPTION OF THE PREFERRED EMBODIMENT

Figure 1:
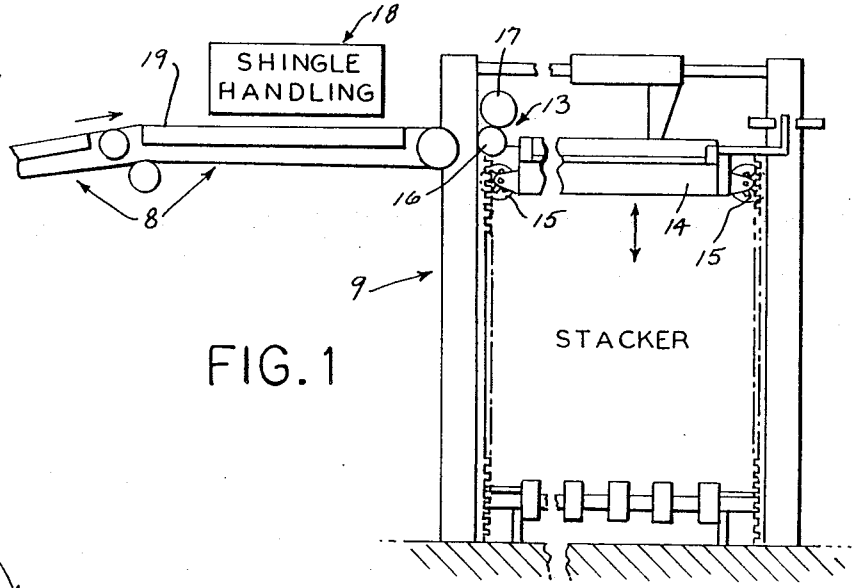
FIG. 1 is a schematic in-line view of a shingling and stacking device which incorporates the various aspects of the invention.

As best shown in FIG. 1, the concepts of the invention may be embodied in a device of the type disclosed in the aforementioned U.S. Pat. No. 4,200,276. The device includes, in line, an input conveyor section 1 for entrance of a web 2 of corrugated paperboard or the like, a cutting section 3 for separating web 2 into separate sheets, a speedup conveyor section 4, a vacuum conveyor section 5 which causes the sheets to overlap into shingled for as at 6, an accumulating conveyor section 7, a stack infeed conveyor section 8 and a sheet stacker 9. The details of these sections are fully disclosed in the aforementioned U.S. Pat. No. 4,200,276, which is incorporated in its entirety herein by reference.

Briefly as to vacuum conveyor section 5, a vacuum box 10 is disposed between the upper and lower flights of a vacuum conveyor 11, with box 10 having an opening 12 in its top which is connected to a source of negative pressure, not shown. As the cut sheets pass over box 10, they are slowed down and shingled thereby. As to stacker 9, the shingled sheets 6 enter a stacker infeed nip 13 and pass onto a roller-type platform 14 which is vertically movable within the stacker frame, as by motor means 15.

Nip 13 is shown as formed by a lower driving roller 16 which is normally engaged by an upper and larger free-wheeling nip roll 17, with the latter being suitably mounted in the usual manner (not shown) for raising and lowering in response to sheets passing through the nip.

As previously described, the overlapping shingled sheets 6, which may be formed into discrete stacks by the device, sometimes tend to become skewed as they pass downstream from vacuum conveyor section 5 to stacker 9. This may occur any place along accumulating conveyor section 7 or stack infeed conveyor section 8. If any of the sheets 6 in the stack remain skewed relative to the longitudinal conveyor axis, they will pass through nip 13 and onto platform 14 out of alignment, possibly causing undesirable damage to the sheets. Various aspects of the present invention are directed to a unique manner of solving this problem.

Referring to FIG. 1, a shingle handling device 18 is disposed directly above the conveyor belt 19 of stack infeed conveyor section 8, and preferably closely adjacent, but upstream of, infeed nip 13 for stacker 9. This positioning of device 18 assures that further skewing will not occur before shingled sheets 6 reach the stacker.

Figure 2:
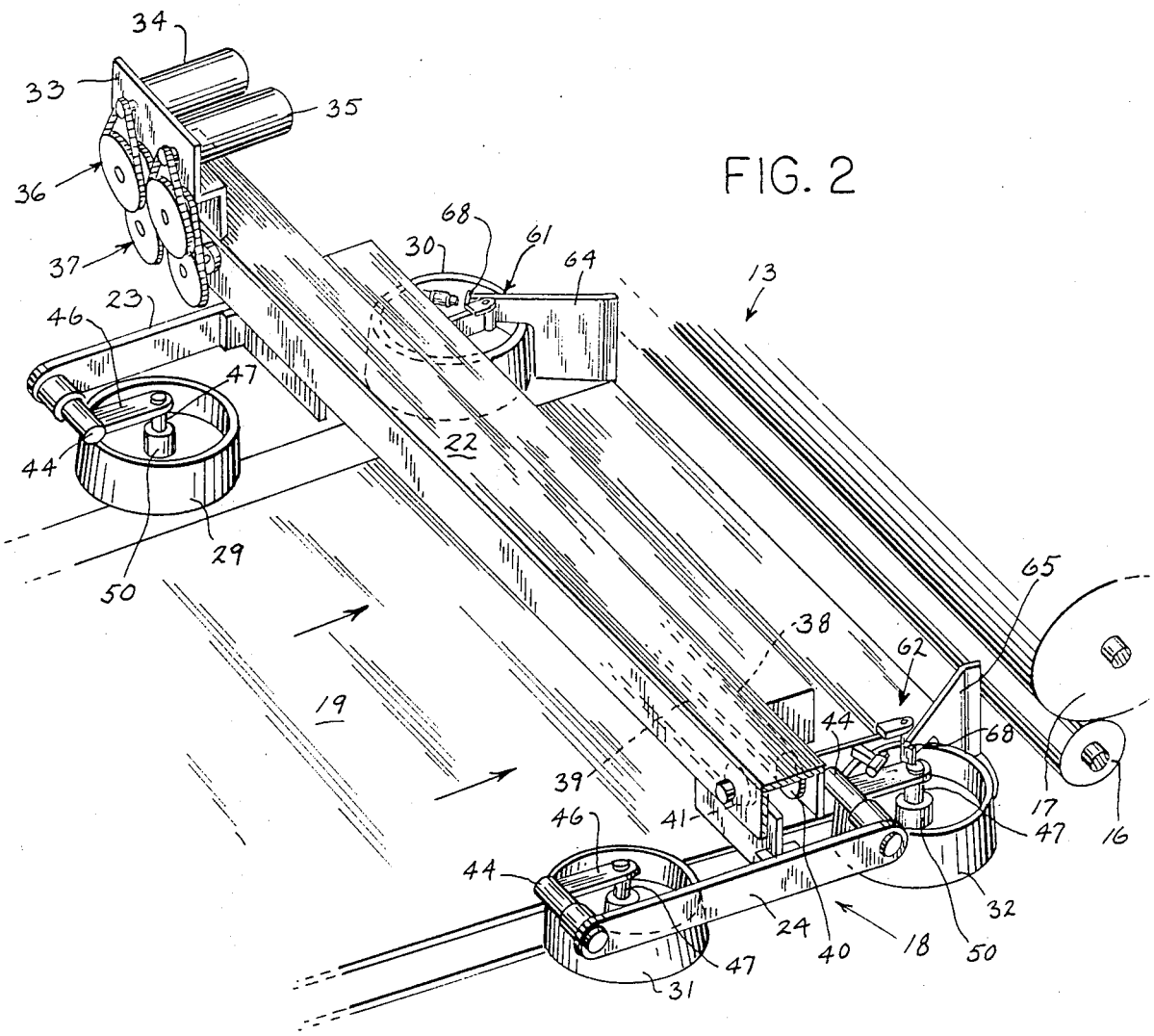
FIG. 2 is an enlarged perspective generally schematic view of the squaring device, with parts broken away and removed for purposes of clarity.
Figure 3:
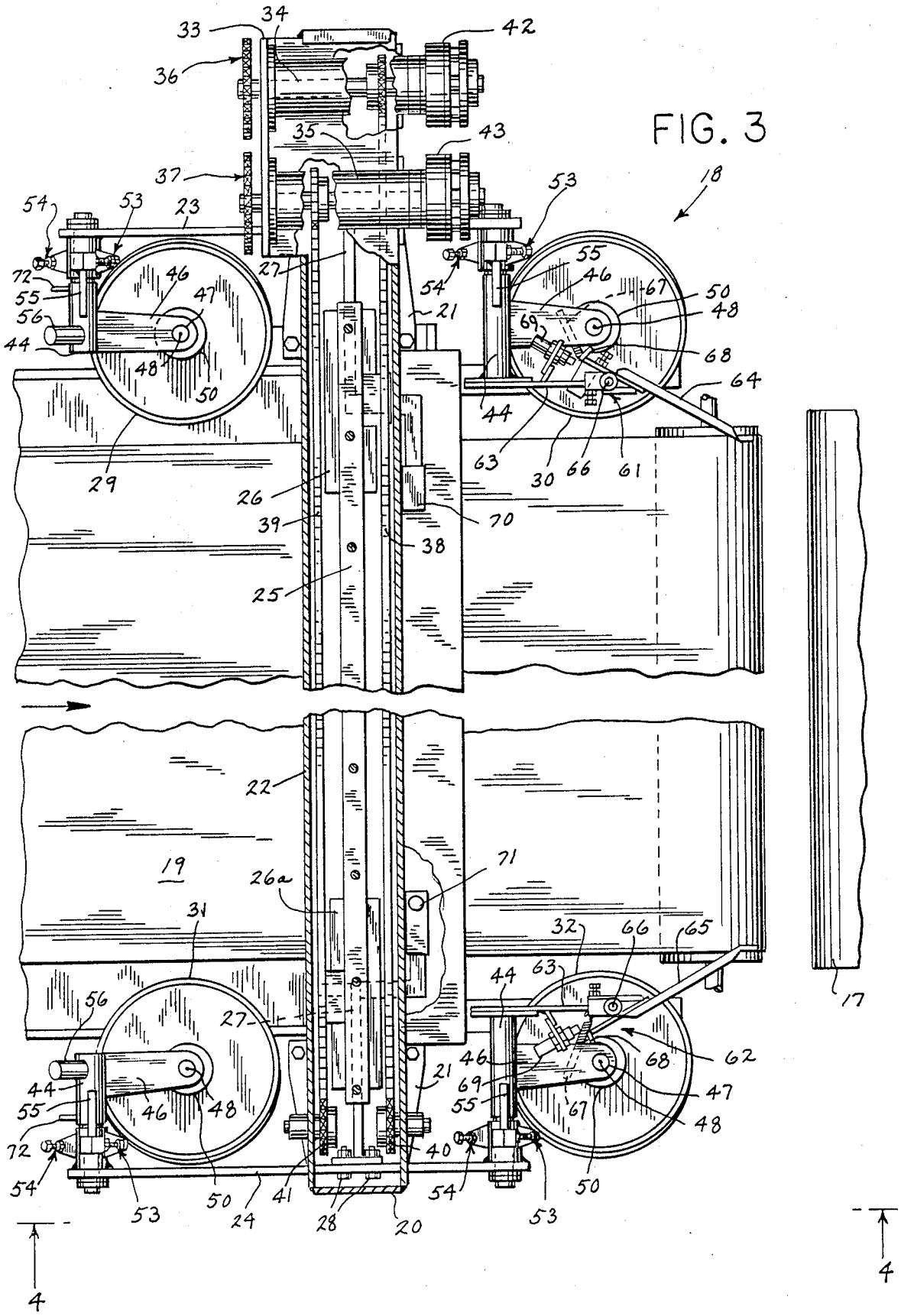
FIG. 3 is a top plan view of the squaring device.
Figure 4:
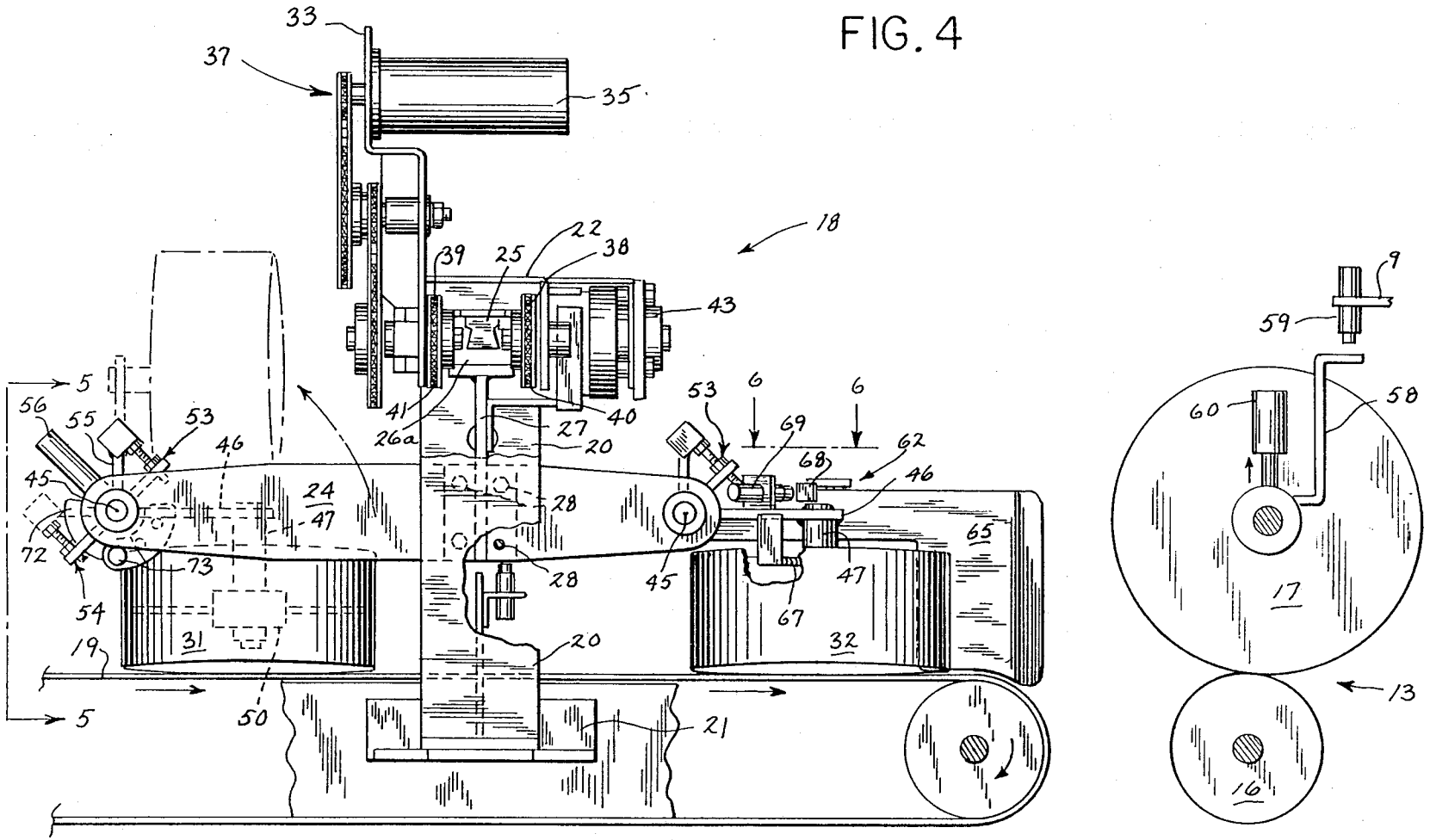
FIG. 4 is a side end view taken on line 4—4 of FIG. 3, and with parts broken away.

As best shown in FIGS. 2, 3, and 4, shingle handling device 18 includes a supporting frame which generally comprises a pair of transversely aligned vertical legs 20 disposed on each side of conveyor 19 and secured in any desired manner to the overall machine frame 21. The upper ends of legs 20 support the ends of a transversely extending channel-shaped beam 22 having an open bottom.

Beam 22 serves as a support for a pair of tranversely movable arm-like carriages 23,24 which are suspended downwardly therefrom and normally disposed generally adjacent the beam ends. For this purpose, an elongate track 25 is secured within the beam and suitably carries a pair of linear bearings 26,26*a*, one for each carriage, which are adapted to slide therealong. Each bearing has secured thereto and carries a downwardly extending bracket 27 which in turn is secured to one of the carriages, as by bolts 28.

As will be described more fully hereinafter, each carriage 23,24 incorporates and carries a pair of longitudinally in-line sheet engaging tamping rollers or wheels. When viewed from the top as in FIG. 3, and looking downstream, the left carriage 23 carries an upstream wheel 29 and a downstream wheel 30. Likewise, the right carriage 24 carries an upstream wheel 31 and a downstream wheel 32. Wheels 29–32 are preferably of light weight low-inertia type.

Means are provided for driving carriages 23 and 24 along beam 22 between outer and inner positions. For this purpose, a bracket 33 is secured to one end of beam 22, and a pair of reversible motors 34,35 are mounted to the bracket. As shown, the motor output shafts are connected through suitable speed reducing gear arrangements 36,37 which in turn mount suitable drive chains 38,39, respectively. Chains 38,39 extend through beam 22 and are trained about suitable sprockets 40,41 on the opposite beam end. As best seen in FIG. 3, chain 38 is attached through linear bearing 26 to carriage 23, while chain 39 is attached through linear bearing 26*a* to carriage 24. The resultant construction is such that actuation of motor 34 drives carriage 23 transversely in a selected direction, with actuation of motor 35 likewise driving carriage 24. In addition, suitable brakes 42,43 are attached to the output shafts of respective motors 34,35.

Figure 5:
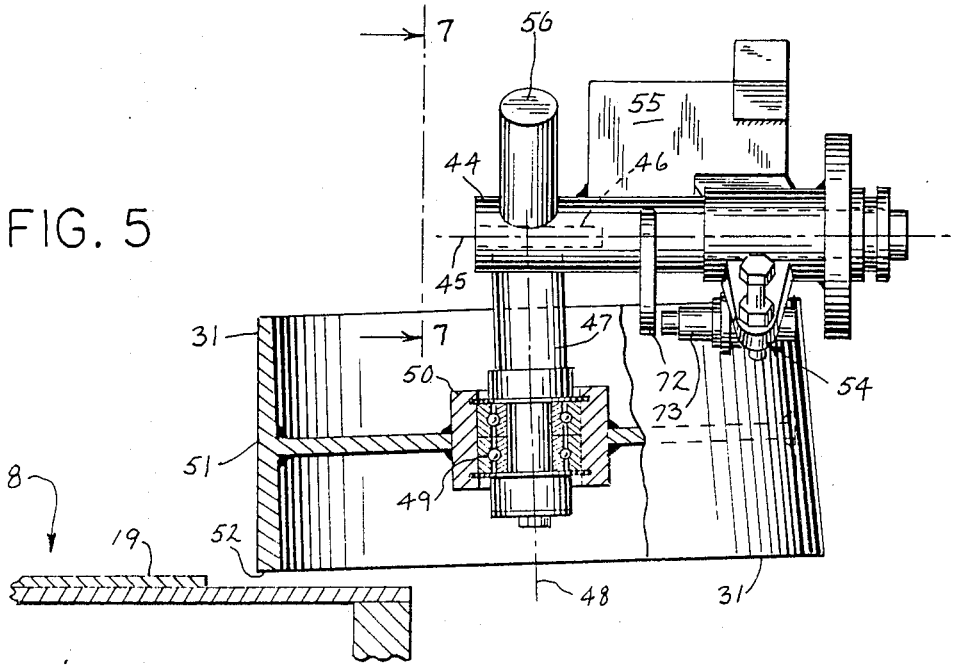
FIG. 5 is an upstream end view of one of the carriages in generally neutral outward position, taken on line 5—5 of FIG. 4, and with parts broken away and in section.

Returning now to sheet tamping wheels 29–32, each wheel is constructed and mounted substantially similarly. Referring primarily to FIGS. 2 and 5, a shaft 44 defining a horizontal transverse pivot axis 45 is mounted for rotation on each respective carriage 23,24 at the upstream and downstream ends thereof. Each shaft 44 connects through a generally horizontal arm 46 to a support shaft 47 which in turn defines a downwardly extending upright axis 48. The lower end of support shaft 47 carries a bearing 49 which mounts the hub 50 of one of the respective tamping wheels 29–32 so that the wheels are freely rotatable thereon.

In accordance with an aspect of the invention, axis 48 is generally vertical but slightly tilted and inclined at a given angle inwardly and downwardly in a transverse direction relative to the conveyor. Likewise, the outer rim or peripheral portion of each wheel is tapered, as best shown at 51 in FIG. 5. The result of the offset of the wheel axis 48 is to permit each wheel to rotate on a tilted axis so that only an inner portion 52 of the lower edge of the wheel is closely adjacent to and can come in contact with conveyor belt 19. Although each wheel is usually set so that the edge portion 52 is higher than generally horizontal conveyor belt 19, as in FIG. 5, a warped or otherwise irregular belt could possibly come in contact with edge 52 when the wheel is over the belt. By mounting each wheel so that it is rotatable on a tilted axis, and with contact by an irregular belt with a wheel disposed thereover, the wheel can only rotate in a single driving direction, which is the same direction as the stack of traveling sheets 6 which engage the wheel periphery. Also, if traveling horizontal sheets tend to move to a position under the wheel, as in a jam to be described hereinafter, the sheets will tend to be driven through by the wheel. This is in contrast with a device wherein the wheel is mounted on a strictly vertical axis, in which case the bottom wheel edge would be parallel to the belt so that the wheel might very well be caused to indiscriminately rotate in either direction upon engagement with an irregular belt or sheet jam, depending upon the shape and position of the irregularity. This could damage the adjacent shingled sheets 6. In addition, the result of the tapered rim 51, with an angle of taper corresponding to the angle of tilt of axis 48, is to dispose rim 51 perpendicular to belt 19 and permit the wheel, even though mounted on a tilted axis, to present a truly vertical face to the traveling sheets 6, which is of course desirable.

The wheel mounting just described permits each wheel 29–32 to be pivotally lifted about a transverse axis 45 between a lowermost position (usually just slightly above conveyor belt 19 as in FIG. 5) limited by an adjustable stop 53, and an uppermost position limited by a further adjustable stop 54. Stops 53 and 54 are mounted for fixed connection to the respective adjacent carriage 23,24, and are adapted to be engaged by a finger 55 or the like attached to shaft 44 for rotation therewith. See especially FIG. 7. In addition, the assemblies associated with upstream wheels 29 and 31 are counterbalanced, as by rod-like weights 56 secured and disposed on the upstream sides of the respective transverse pivot shafts 44, as most clearly seen in FIGS. 3, 5 and 7. The counterbalancing assists in creating a "soft touch" when the wheels are involved in a jam, to be described.

Turning now to the further handling of the shingled sheets 6, the various operations are under the control of a suitable controller 57 (FIG. 11) which is programmable in the usual way to actuate the various mechanisms in the desired cycleably operable manner in response to sensing devices mounted on the machine. One such controller is manufactured and sold by the Allen-Bradley Co. of Milwaukee, Wis., under Model No. SLC-100.

It is first desired to determine whether a stack of shingled sheets 6 is present in device 18. This determination is made at stacker infeed nip 13. Referring to FIGS. 4 and 11, when sheets 6 enter nip 13, nip roll 17 will be caused to be raised on its frame (not shown) by the sheets in the usual manner. Means for detecting this raising are provided, and in the embodiment shown comprises a bracket 58 mounted to the nip roll frame and which activates a proximity sensor 59 mounted on stacker 9 upon raising of nip roll 17 by the sheets. The signal from sensor 59 is fed to controller 57, which is programmed to actuate a nip cylinder 60 mounted on the nip roll frame. Actuation of cylinder 60 causes nip roll 17 to continue raising so that it is out of contact with and released from either straight or skewed sheets 6, and then stay in the raised position. This prevents binding of sheets 6 in nip 13 during subsequent operations.

Next, the originally outwardly disposed carriages 23,24 are actuated to come into ultimate contact with sheets 6 and to square any sheets that are undesirably skewed. The construction is such that no matter what the transverse position of the sheet stack is, whether centered on the longitudinal center line or axis of belt 19 or disposed off-center, the carriages will properly engage, handle and square the sheets.

Figure 6:
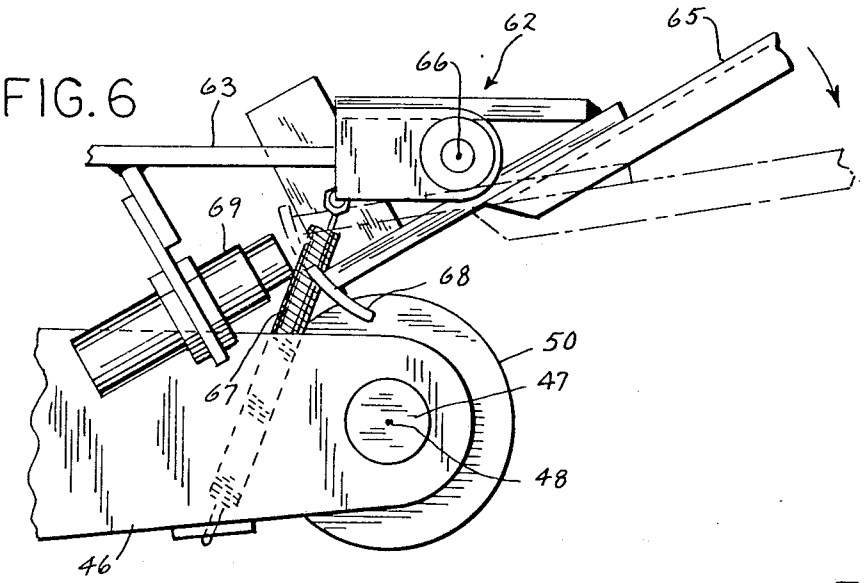
FIG. 6 is an enlarged fragmentary plan view of a sheet edge sensing arrangement, taken on line 6—6 of FIG. 4.

For this purpose, and referring especially to FIGS. 3 and 6, each downstream wheel 30,32 is provided with a sheet sensing assembly 61,62, respectively, with the assemblies being preferably closely adjacent and just upstream of stacker infeed nip 13. The assemblies are essentially identical. The assemblies comprise, respectively, brackets 63 secured for rotation with the horizontal wheel pivot shafts 44. Sheet engageable arm-like sensing paddles 64,65 are mounted to their respective bracket 63 for horizontal pivoting movement, as on axis 66. Paddles 64,65 are biased transversely inwardly by springs 67 secured to the respective paddles and extending to the respective wheel mounting arms 46. Shutters 68 are disposed on the inner paddle portions and are disposed closely adjacent sensing devices, such as proximity sensors 69 mounted on brackets 63. Sensors 69 are responsive to the position of shutters 68 to each provide an input from sensing assemblies 61,62 to controller 57, as shown in FIG. 11.

Figure 8:
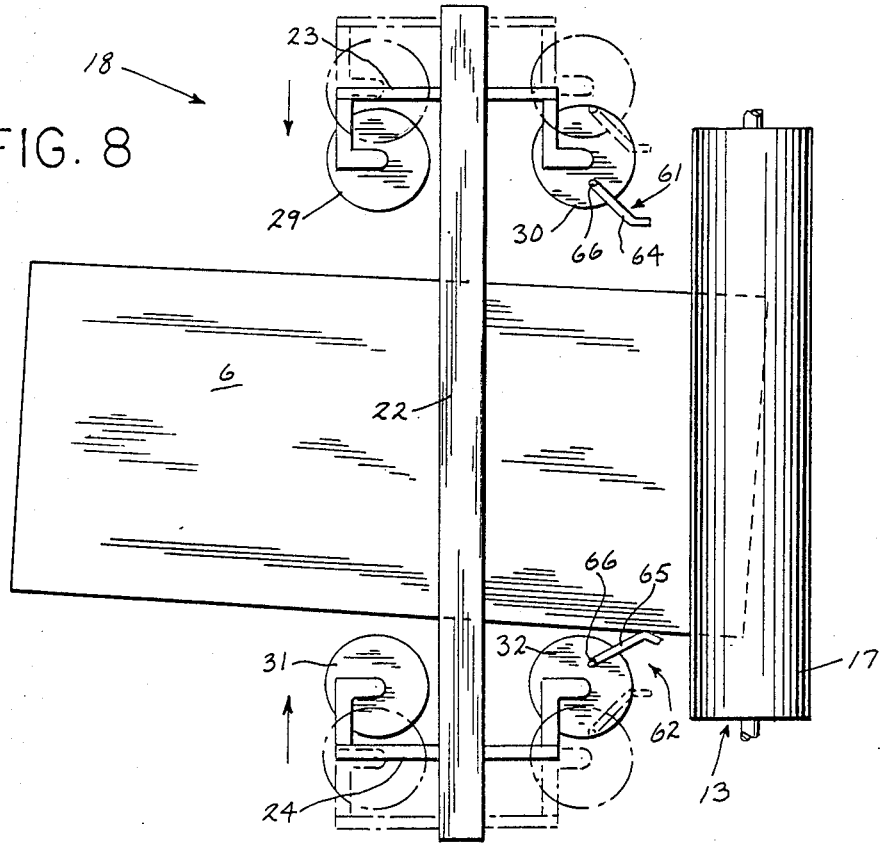
FIG. 8 is a schematic top plan showing of the squaring device and illustrating the first phase of the squaring procedure.
Figure 9:
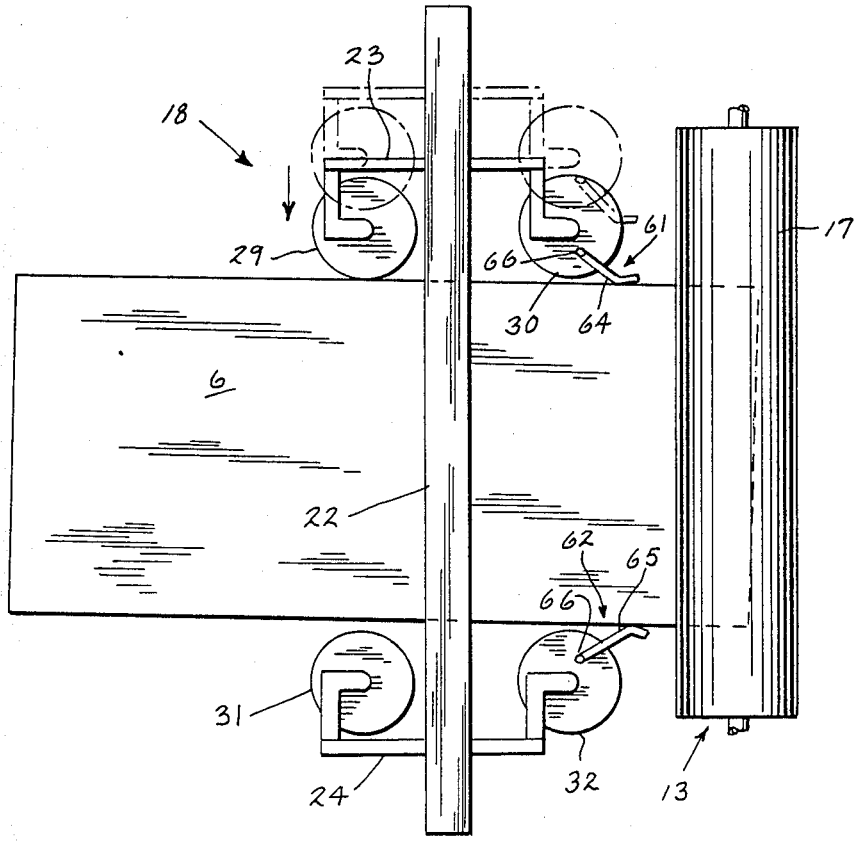
FIG. 9 is a showing similar to FIG. 8 and illustrating the second phase thereof.

Controller 57 is suitably programmed so that when nip roll 17 is released from sheets 6, motors 34 and 35 are caused to drive the respective carriages 23 and 24 at relatively high speed from their initial outward positions and transversely inwardly toward sheets 6. Assume that the stack of sheets is positioned at least somewhat off-center and/or one or more sheets are improperly skewed. Thus, paddles 64 and 65 will initially be at different distances from the sheets. Referring to FIG. 8, which shows a sheet 6 skewed to the right, as the carriages travel inwardly, right paddle 65 will engage the right edge of sheet 6 firstly, which creates an output from right sheet sensing assembly 62 to controller 57 which is programmed to stop motor 35 and brake (as by brake 43) right carriage 24. It is preferable to thus stop carriage 24 so that downstream right wheel 32 is spaced slightly at a given distance (such as 2 inches) from the right sheet edge at this point. Referring to FIG. 9, left carriage 23 will continue moving inwardly until left paddle 64 engages the left edge of the sheet, which creates an output from left sheet sensing assembly 61 to controller 57 which is programmed to then stop motor 34 and brake (as by brake 42) left carriage 23. Carriage 23 is thus stopped so that downstream left wheel 30 is also spaced slightly from the left sheet edge at a distance essentially equal to said given distance.

It should be noted that in this example and as carriage 23 moves in, left upstream wheel 29 may actually engage the left sheet edge before carriage 23 stops, as shown in FIG. 9. A slight but incomplete straightening of the sheet may thus result.

Controller 57 is programmed so that once both carriages 23 and 24 have been stopped, they are automatically re-started again and are driven so that they move inwardly at low speed. During this movement, the final results of which are shown in FIG. 10, the tamping wheels engage and fully square sheet 6. A torque limiting device (not shown) associated with the wheels then causes both carriages to stop in their final sheet-engaging positions and be locked in place by brakes 42,43. Once this occurs, controller 57 is caused to lower nip roll 17 into engagement with the stack of sheets therein so that the stack can now be driven through stacker infeed nip 13.

Means are also provided so that in the unlikely event that carriages 23 and 24 are driven inwardly when no stack of sheets 6 is present, they will be stopped before they collide. For this purpose, and as best shown in FIG. 3, a shutter 70 is mounted to linear bearing 26 and a proximity sensor 71 is mounted to linear bearing **26*a*. Shutter 70 and sensor 71 are positioned so that if the carriages approach each other to the point of impending collision, sensor 71 will be activated to cause controller 57** to stop or reverse the carriage movement.

Figure 7:
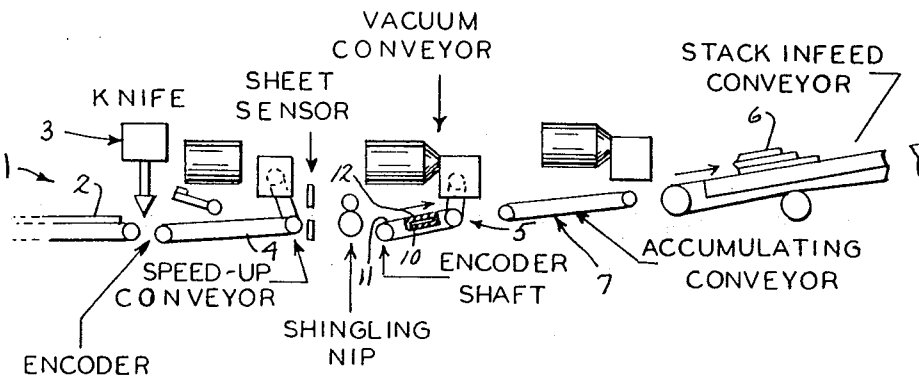
FIG. 7 is an enlarged fragmentary view of the wheel adjustment mechanism and jam detecting arrangement, taken on line 7—7 of FIG. 5.
Figure 7:
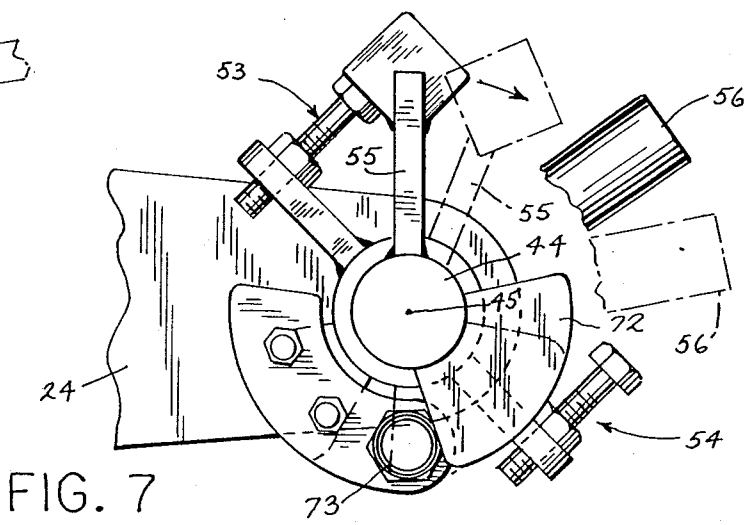

An aspect of the present invention contemplates the automatic detection and release of jams that may occur adjacent shingle handling device 18. For this purpose, a suitable jam sensing device is preferably disposed in association with each upstream sheet tamping wheel 29 and 31. The jam sensing devices may be substantially identical. As best shown in FIGS. 5 and 7 which illustrate only the right upstream wheel 31, a shutter 72 is secured for rotation with transverse horizontal wheel pivot shaft 44 and is disposed closely adjacent a proximity sensor 73 fixedly connected to carriage 24. If a jam occurs which causes wheel 31 to pivot upwardly an inordinate amount by sheets passing thereunder, sensor 73 will be activated by shutter 72 to input a signal to controller 57 which is programmed to then cause carriages 23 and 24 to move outwardly and separate the tamping wheels from sheets 6 to clear the jam. Once this has occurred, wheel 31 will pivotally lower. Controller 57 may be programmed to then automatically restart the cycle discussed above, wherein nip roll 17 raises and carriages 23 and 24 are intially moved in at high speed.

The various aspects of the invention provide an efficient and unique manner of handling stacks of sheets traveling on a conveyor.

Various modes of carrying out the invention are contemplated as being within the scope of the following claims particularly pointing out and distinctly claiming the subject matter which is regarded as the invention.

We claim:

1. A device for handling traveling sheets of paperboard or the like, comprising, in combination:

(a) a conveyor (19) for transporting said sheets (6) longitudinally in an upstream-to-downstream direction, (b) sheet squaring means disposed along said conveyor and including transversely opposed carriage means (23,24) disposed on each side of said conveyor, (c) generally cylindrical sheet engaging wheel means (29–32) disposed on each o said carriage means and above said conveyor, and with said wheel means having a peripheral face (51) and a lower edge facing said conveyor, (d) means (44,47) mounting said wheel means for pivotal movement about a generally horizontal tranversely extending axis (45), and for rotation about an upright axis (48), (e) said upright axis being slightly inclined at a given angle from the vertical so that only a portion (52) of the lower edge of said wheel means is engageable by said conveyor in the event of a vertical irregularity in the latter whereby said wheel means is rotatably drivable in only one direction by said irregular conveyor, (f) and said peripheral face (51) of said wheel means being generally cylindrical but tapered at an angle corresponding to said given angle so that said tapered face is disposed substantially vertically for engagement with the edges of sheets traveling along said conveyor.

2. A device for handling traveling sheets of paperboard or the like, comprising, in combination:

(a) a conveyor (19) for transporting said sheets (6) longitudinally in an upstream-to-downstream direction, (b) a stacker infeed nip (13) disposed along said conveyor for receipt of said sheets therethrough, and with said nip including a nip roll (17) beneath which said sheets pass and with said nip roll being vertically shiftable thereby, (c) sheet sensing and squaring means (23,24) disposed upstream of said nip and with said means being cycleably operable to engage and disengage from said sheets, (d) nip sensing means (58,59) for detecting vertical raising of said nip roll by said sheets as the latter pass into said nip, (e) and means (60) responsive to said nip sensing means for further raising said nip roll and out of engagement with said sheets so that said sheet sensing and squaring means (23,24) can cycle without binding of said sheets within said nip.

3. A device for handling traveling sheets of paperboard or the like, comprising, in combination:

(a) a conveyor (19) for transporting said sheets (6) along a longitudinal center line in an upstream-to-downstream direction, (b) transversely movable opposed carriage means (23,24) disposed on each side of said conveyor, (c) sheet sensing means (61,62) mounted to said carriage means, said sheet sensing means including:

(1) pivotal paddle means (64,65) disposed adjacent the downstream end portion of said carriage means, and with said paddle means being biased transversely inwardly toward said sheets, (2) and proximity sensor means (69) disposed adjacent said paddle means and responsive to paddle pivoting upon engagement by said paddle means with an edge of a sheet, (d) and sheet squaring means including tamping wheel means (29–32) mounted to said carriage means and responsive to said sheet sensing means for engaging the edges of said sheets to square and hold the traveling sheets in longitudinal alignment, (e) said sheet sensing means and said sheet squaring means comprising cooperative means to automatically square and longitudinally align traveling sheets which are offset from said longitudinal center line.

4. A device for handling and squaring traveling sheets of paperboard or the like and wherein said sheets tend to be skewed out of line, comprising, in combination:

(a) a conveyor (19) for transporting said sheets (6) longitudinally in an upstream-to-downstream direction, (b) first and second transversely opposed carriages (24,23) disposed respectively on each side of said conveyor, (c) first and second motive means (35,34) connected to drive said respective first and second carriages transversely of said conveyor between outer and inner positions, (d) an upstream and downstream sheet tamping wheel (29–32) mounted on each of said carriages, (e) first and second sheet sensing means (62,61) mounted on said respective first and second carriages adjacent a respective downstream tamping wheel (32,30), (f) the arrangement being such that when said carriages are at said outer position, said first and second sheet sensing means are disposed at different distances from their respective skewed sheet edges so that when said first and second motive means drive said carriages inwardly, said first and second sheet sensing means sense the respective skewed sheet edges sequentially with said first sheet sensing means (62) sensing a sheet edge first, (g) and control means for causing said first and second motive means to initially drive said carriages approachingly transversely inwardly in a traveling mode toward a skewed sheet, said control means being responsive to said first and second sheet sensing means and further comprising:

(1) means to deactivate said first motive means (35) upon sensing of a sheet edge by said first sheet sensing means (62) to thereby stop travel of said first carriage (24), and with the latter's downstream sheet tamping wheel (32) spaced a given distance from one sheet edge, (2) means to subsequently deactivate said second motive means (34) after stopping of said first carriage and upon sensing of the other sheet edge by said second sheet sensing means (61) to thereby stop travel of said second carriage (23), and with the latter's downstream sheet tamping wheel (30) spaced from the said other sheet edge a distance essentially equal to said given distance, (3) and means to thereafter re-activate both said first ad second motive means (35,34) to thereby bring said downstream tamping wheels (32,30) into squaring engagement with the sheet.

5. The combination of claim 4 in which:

(a) said first and second motive means (35,34) initially drive said carriages (24,23) at a relatively high speed, (b) and said re-activated first and second motive means drive said carriages at a relatively low speed.

6. The combination of claim 4 in which said first and second sensing means (62,61) each include:

(a) a paddle (64) pivotally mounted adjacent a downstream sheet tamping wheel (32,30), (b) and a proximity sensor (69) disposed adjacent said paddle and responsive to paddle pivoting upon engagement by the paddle with a sheet edge.

7. The combination of claim 4 which includes carriage collision prevention means (70,71) for reversing inward travel of said first and second carriages upon lack of a sheet therebetween.

8. The combination of claim 4 which includes:

(a) means (44) mounting said upstream tamping wheels (29,31) for pivotal movement about a generally horizontal transverse axis (45), (b) and jam detection means (72,73) associated with said upstream wheels for sensing inordinate upward pivoting of the latter caused by passage of sheets under said wheels.

9. The combination of claim 8 in which said control means includes means responsive to said jam detection means to cause said first and second motive means (34,35) to move said carriages (23,24) transversely outwardly and away from said sheets to clear the jam.

10. The combination of claim 8 which includes means (56) disposed on said wheel mounting means (44) to counterbalance said upstream sheet tamping wheels (29,31).

11. A method for handling and squaring traveling sheets of paperboard or the like and wherein said sheets tend to be skewed out of line, comprising the steps of:

(a) providing (1) a conveyor (19) for transporting said sheets (6) longitudinally in an upstream-to-downstream direction, (2) first and second transversely opposed carriages (24,23) disposed respectively on each side of said conveyor, (3) first and second motive means (35,34) connected to drive said respective first and second carriages transversely of said conveyor between outer and inner positions, (4) an upstream and downstream sheet tamping wheel (29–32) mounted on each of said carriages, (5) and first and second sheet sensing means (62,61) mounted on said respective first and second carriages adjacent a respective downstream tamping wheel (32,30), (b) causing said first and second motive means to initially drive said carriages approachingly transversely inwardly in a traveling mode toward a skewed sheet in response to said first and second sheet sensing means, (c) deactivating said first motive means (35) upon sensing of a sheet edge by said first sheet sensing means (62) to thereby stop travel of said first carriage (24) and so that the latter's downstream sheet tamping wheel (32) is spaced a given distance from one sheet edge, (d) subsequently deactivating said second motive means (34) after stopping of said first carriage and upon sensing of the other sheet edge by said second sheet sensing means (61) to thereby stop travel of said second carriage (23), and so that the latter's downstream sheet tamping wheel (30) is spaced from the said other sheet edge a distance essentially equal to said given distance, (e) and thereafter re-activating both said first and second motive means (35,34) to thereby bring said downstream tamping wheels (32,30) into squaring engagement with the sheet.

* * * * *